US005713519A

United States Patent [19]

Sandison et al.

[11] Patent Number: 5,713,519

[45] Date of Patent: Feb. 3, 1998

[54] FLUID SPRAYING SYSTEM

[75] Inventors: W. Bruce Sandison, St. Louis Park; Russell E. Blette, Hastings, both of Minn.

[73] Assignee: Minnesota Mining and Manufacturing Company, St. Paul, Minn.

[21] Appl. No.: 505,088

[22] Filed: Jul. 21, 1995

[51] Int. Cl.[6] ..... B05B 7/08

[52] U.S. Cl. ..... 239/8; 239/307; 239/369; 239/419.3; 239/433; 239/327

[58] Field of Search ..... 239/8, 304, 307, 239/327, 340, 346, 351, 369, 543, 419.3, 433; 401/35

[56] References Cited

U.S. PATENT DOCUMENTS

| | | | |
|---|---|---|---|
| 868,715 | 10/1907 | Skinner | 299/106 |
| 2,739,843 | 3/1956 | Baur | 299/140.1 |
| 2,813,751 | 11/1957 | Barrett | 299/86 |
| 2,829,006 | 4/1958 | Johansson | 299/140.1 |
| 2,998,934 | 9/1961 | Broughton | 239/521 |
| 3,021,079 | 2/1962 | Sovia et al. | 239/306 |
| 3,033,472 | 5/1962 | Shelton-V | 239/408 |
| 3,178,118 | 4/1965 | New | 239/304 X |
| 3,258,207 | 6/1966 | Cody | 239/336 |
| 3,416,709 | 12/1968 | Shultz et al. | 222/94 |
| 3,606,154 | 9/1971 | Tufts | 239/8 |
| 3,716,190 | 2/1973 | Lindlof | 239/8 X |
| 3,799,914 | 3/1974 | Schmit et al. | 426/85 |
| 4,103,827 | 8/1978 | Kumazawa | 239/8 |
| 4,138,036 | 2/1979 | Bond | 222/105 |
| 4,397,422 | 8/1983 | Gwyn | 239/307 |
| 4,718,738 | 1/1988 | Bell | 383/121 |
| 4,781,329 | 11/1988 | Tenney et al. | 239/305 |
| 4,824,017 | 4/1989 | Mansfield | 239/9 |
| 4,854,504 | 8/1989 | Hedger, Jr. et al. | 239/294 |
| 4,903,718 | 2/1990 | Sullivan | 134/184 |
| 4,928,884 | 5/1990 | Smith | 239/290 |
| 4,936,511 | 6/1990 | Johnson et al. | 239/346 |
| 4,971,251 | 11/1990 | Dobrick et al. | 239/346 |
| 5,005,736 | 4/1991 | Portas | 222/135 |
| 5,031,798 | 7/1991 | Wild | 222/82 |
| 5,059,036 | 10/1991 | Richison et al. | 383/61 |

(List continued on next page.)

FOREIGN PATENT DOCUMENTS

| | | | |
|---|---|---|---|
| 0 371 634 | 11/1988 | European Pat. Off. | B05B 7/24 |
| 383839 | 1/1965 | Switzerland | 239/304 |
| 1717249 | 3/1992 | U.S.S.R. | 239/307 |
| 1 345 985 | 2/1974 | United Kingdom | B05B 7/30 |
| 1525 | 4/1984 | WIPO | 239/304 |
| WO 92/17280 | 10/1992 | WIPO . | |
| WO 95/05998 | 3/1995 | WIPO . | |

OTHER PUBLICATIONS

Binks Manufacturing Company, Franklin Park, Illinois, Part Sheet 2547 entitled, "Binks MACH 1C HVLP Spray Gun For Plural Component Catalyst Injection," pp. 1–8 (Jun. 1991).

Binks Manufacturing Company, Franklin Park, Illinois, catalog entitled, "Spray Guns: Specifications and Guide to Selection," 65 pp. (Jan. 1992).

The Society of the Plastics Industry, Inc., specification entitled, "Cosmetic Specifications of Injection Molded Parts, Specifications for Molders and Their Customers," 1994 Edition, pp. 1–21.

*Primary Examiner*—Kevin Weldon

*Attorney, Agent, or Firm*—Leland D. Schultz; Gary L. Griswold; Walter N. Kirn

[57] ABSTRACT

A system and method for spraying single or multiple component fluid systems onto a surface. The spray applicator utilizes a venturi effect to independently draw fluids from separate containers, atomize the fluids and spray the fluids in a desired pattern onto a surface. The atomized streams generally overlap so that the fluids mix prior to contacting the target surface. In one embodiment, the fluids are retained in flexible containers separately connected to a spray applicator by flexible tubes. The flexible containers include a fitting for receiving a fluid draw tube and a releasable closure for expelling excess pressure within the container.

30 Claims, 9 Drawing Sheets

U.S. PATENT DOCUMENTS

| | | | |
|---|---|---|---|
| 5,100,060 | 3/1992 | Haferkorn | 239/337 |
| 5,135,172 | 8/1992 | Toth | 239/297 |
| 5,143,294 | 9/1992 | Lintvedt | 239/328 |
| 5,147,272 | 9/1992 | Richison et al. | 493/195 |
| 5,246,163 | 9/1993 | Amano et al. | 239/1 |
| 5,254,073 | 10/1993 | Richison et al. | 493/195 |
| 5,255,852 | 10/1993 | Morrison | 239/346 |
| 5,303,865 | 4/1994 | Bert | 239/9 |
| 5,346,135 | 9/1994 | Vincent | 239/306 |
| 5,360,144 | 11/1994 | Slade | 22/134 |

FLUID SPRAYING SYSTEM

FIELD OF THE INVENTION

The present invention relates to a method and apparatus for spraying fluids and more particularly, to a system for spraying multiple component fluid systems. The present invention also relates to a flexible polymeric container with an integral pressure relief system for retaining components of a fluid system.

BACKGROUND OF THE INVENTION

Spraying fluid materials, such as paints, stains, adhesives, lubricants, and pesticides, through a nozzle onto a substrate is a common and effective method of application. When multiple component fluid systems are to be applied, there are several ways that the components may be combined. For example, the multiple components may be applied sequentially. This method of combining the components requires more than one pass across the substrate and may require a separate spray applicator for each individual component. Additionally, the components are not mixed prior to contact with the substrate, but rather applied in layers.

Another method of combining multiple component fluid systems is to mix the components prior to their application to the substrate. The components may be mixed either before they leave the spray applicator or after they leave the spray applicator, but before reaching the substrate.

The individual components of many multiple component fluid systems react in a manner that is undesirable if combined prior to application to the target substrate. When the components are mixed internal to the spray applicator, the reaction between the components may occur earlier than desired and thereby reduce the performance of the multiple component fluid system, either in the application process or after the coating has been applied to the substrate. Additionally, the components of some multiple component fluid systems may be corrosive to some materials or parts of the spray applicator, either in their individual component form or when combined, or may clog the nozzle.

In the case of multiple component adhesives, the components are generally an adhesive base and an activator or catalyst which causes the adhesive to cure. The two components must be mixed at the time they are applied to the substrate. When a multiple component adhesive is mixed prior to leaving the spray applicator, the mixture is applied through a single spray nozzle. However, upon mixing the adhesive base and activator, the adhesive immediately begins to cure. Premature curing of the adhesive can cause a build-up of adhesive around the orifice of the nozzle, resulting in interference with the nozzle spray pattern and decreased spraying efficiency. Further, internal mixing of multiple component adhesive systems requires meticulous cleaning of the internal parts of the spray applicator. Additionally, as the adhesive begins to cure, its fluid properties begin to change, with a corresponding deterioration in nozzle spray pattern and spraying efficiency.

The above-described disadvantages can be overcome by mixing the components after they leave the spray applicator, but before being applied to the substrate, using a multi-nozzle spraying apparatus. Typically, two adjacent, atomizing nozzles are positioned so that the various components intermingle and mix prior to reaching the substrate. By spraying each component through a separate nozzle and combining the components external to the spray applicator, the reaction between the components is delayed until immediately prior to contact with the substrate. However, currently available multiple component spraying systems tend to be heavy and complex. Additionally, current multiple component spraying systems provide inadequate atomization, and consequently, incomplete mixing for some multiple component fluid systems.

Systems for spraying multiple component fluid systems are known in the art, as is illustrated in FIG. 1. Spray applicator 10 is connected by connector 12 to air hose 14. Air hose 14 is connected at one end to a source of pressurized air (not shown) and at another end to a handle end 17. A passageway extends through the handle end 17 and barrel end 18 to a spray applicator bracket assembly 21 and nozzle assembly 16. Trigger 20 actuates a valve actuator 19 that controls the flow of the pressurized air through the spray applicator 10.

A first bottle 22 and a second bottle 24 are each directly mounted on and supported by the spray applicator bracket assembly 21. The first bottle 22 is for receipt of a quantity of a first fluid and the second bottle 24 is for receipt of a quantity of a second fluid. Draw tubes 26 and 28 extend into the first and second bottles, respectively, in fluid communication at one end with the first and second fluids.

The nozzle assembly 16 is detachably mounted on the spray applicator 10 operatively connected to the passageway. The nozzle assembly 16 utilizes air pressure to draw out the first fluid from the first bottle 22. The second nozzle assembly 31 is mounted on the spray applicator bracket assembly 21 and is operatively connected to the body of the spray applicator 10 by air line 30. The nozzle assembly 31 utilizes air pressure from the passageway of the spray applicator 10. The two separate air streams through separate passageways are each restricted and then expanded to an orifice.

When the trigger 20 is actuated, a stream of pressurized air from the spray applicator passes over the ends of the draw tubes 26 and 28 within the separate passageways within the nozzle assembly 16. The reduced pressure acts to draw the first and second fluids upwards through the draw tubes 26 and 28 where the fluid stream is atomized and ejected from the spray applicator 10. Typically, the atomized sprays of the first and second fluids are intermixed at the exterior of the spray applicator 10 prior to encountering the surface to which the fluids are to be applied.

The following is a non-exclusive list of commercially available conventional spray applicator systems generally used in the industry: Binks Manufacturing Company of Franklin Park, Ill.; Graco Incorporated of Minneapolis, Minn. and Mattson Equipment of Rice Lake, Wis. These commercial spray applicators operate using a pressurized fluid transport system using opposing air streams on either side of the fluid stream to give shape and atomization to the exiting fluid. Co-mixing can be accomplished by introducing a second fluid into the shaping air stream or by mounting a separate spray nozzle in much the same fashion as FIG. 1.

FIG. 2 illustrates another spray applicator arrangement 50, including a spray applicator 10', connector 12' and air hose 14'. A nozzle assembly 16' is connected to the spray applicator 10' and includes draw tube 26' that is in fluid communication with a flexible fluid bag 22'. Support 52 is connected at one end to the bag 22' and at the other end to the spray applicator 10'. The nozzle assembly 16' from the spray applicator 10' utilizes air pressure to draw fluid from the bag 22' and to atomize the fluid, as described with respect to the arrangement shown in FIG. 1. In place of the second bottle 24 as in FIG. 1, a pressurized aerosol container 54 is provided. Gripping the trigger 20' actuates air pressure which draws fluid from the fluid bag 22' and simultaneously mechanically actuates the aerosol container 54. Both sprays are simultaneously emitted from the spray applicator 10' and intermix prior to encountering a surface to which the sprayed fluids are to be applied.

FIG. 3 illustrates the exemplary nozzle assembly 16' of FIG. 2 connected to the flexible bag 22'. Fitting 56 forms a seal with the flexible bag 22' enabling one end of draw tube 26' to extend into the interior of the bag 22'. Fitting 57 is adapted to engage quick connect 58 mounted on the draw tube 26' to secure the tube 26' to the bag 22'. The other end of the draw tube 26' is connected by quick connect 58 to connector lock 80 attached to port 60 of the nozzle assembly 16'. Securing mechanism 61 secures locking mechanism 80 to fitting 58.

FIG. 4 further illustrates the nozzle assembly 16'. Port 60 includes conduit 59 communicating with passageway 62 extending from one end of the nozzle assembly 16' to an opposing end. The opposite end of the nozzle assembly includes shroud 64 defining shoulder 66 within the passageway 62. Nozzle assembly 16' may be connected to the spray applicator such as by "J" slot 67 engaging aligned post (not shown) on the spray applicator. The venturi effect may be induced by insert 68 having passageway 70 with a smaller cross-sectional area than passageway 62. The insert 68 may be positioned within shroud 64, located by contact between annular flange 72 of the insert 68 and shoulder 66. Washer 74 having aperture 76 may used to seal the insert when the nozzle assembly 16' is mounted on the spray applicator 10'. The stream of pressurized air flows though aperture 76, passageway 70 and passageway 62. When the air stream emerges from passageway 70, the resulting drop in pressure acts to draw the fluid up from the flexible bag 22' through port 60 into the air stream. It will be appreciated that a similar arrangement may be employed for the spray applicator 10 of FIG. 1.

Both of the arrangements of FIGS. 1 and 2, while having their own utility, have several limitations for certain applications. Specifically, when the fluid containers 22, 22', 24, 54 are directly attached and supported by the spray applicator 10, 10', the total weight of the system may become tiring to carry and operate, particularly over long periods of time. It is also somewhat difficult to remove, refill, or replace the fluid containers while directly connected to a spray applicator.

Further, it is important to provide a spraying system that is as accurate as possible in dispensing and fully atomizing (small particle size and uniform spray pattern) the fluids. For instance, for particular fluids that are to be sprayed and intermixed, maintaining certain flow rates and pressure is critical to optimum spraying. In some prior art spraying systems, incorrectly adjusting the required pressure and flow rate settings on the spray applicator will result in less than optimum application. Further, some fluids may be incompatible, requiring thorough cleaning of the spray applicator and nozzle assembly, which cleaning process may be bothersome and time consuming.

In some circumstances, such as if the nozzle is clogged, pressure in the fluid containers can increase to a critical level. Consequently, the flexible bag 22' illustrated in FIGS. 2 and 3 may burst due to excess pressure.

Recently, two-part water-based adhesives have been introduced to the adhesive market, such as "Fastbond 2000-NF Adhesive" and "Fastbond Spray Activator," manufactured by Minnesota Mining and Manufacturing Company of St. Paul, Minn. This two-part adhesive has different fluid properties than previously available adhesives and requires an accurate ratio of each component. Consequently, current available spraying systems have proven inadequate and/or difficult to use due in part to the adjustability of conventional spray applicators. Specifically, the commonly used nozzle assemblies create a narrow stream of activator fluid exiting the nozzle and impinging upon the spray of adhesive base. When the activator is added to the adhesive base spray in a narrow stream, it is generally only the central portion of the adhesive base spray which is mixed with the activator fluid. The resulting pattern of adhesive on the substrate is incompletely activated. Applicants have found that approximately less than 30% of the adhesive is activated when current two-part water-based adhesives are used in the currently available side injector nozzle assemblies. The remainder of the adhesive base remains wet and fails to function correctly.

SUMMARY OF THE INVENTION

The present invention relates to a nozzle assembly with a preset delivery rate and a fluid spraying system suitable for use with single component or multiple component fluid systems.

The nozzle assembly has an atomizing portion defining a passageway in fluid communication at a first end with pressurized air from a spray applicator. The passageway has a first cross-sectional area proximate the first end, a second cross-sectional area less than the first cross-sectional area proximate a middle portion, and a fluid inlet port between the middle portion and a second end. A portion of the passageway of the first atomizing portion between the middle portion and the second end has a generally frusto-conical shape with a base of the frusto-conical shape proximate the second end so that a reduced pressure condition is created in the passageway proximate the fluid inlet port when pressurized air is supplied to the nozzle assembly.

The spraying system includes at least one container for receiving a fluid. A spray applicator is provided for controlling the flow of pressurized air to a nozzle assembly. A flexible tube fluidly connecting the container with the fluid inlet port is provided so that the fluid is drawn through the fluid inlet port and expelled in an atomized stream from the second end of the atomizing portion when pressurized air is supplied to the nozzle assembly.

Multiple atomizing portions may be provided for independently spraying each component of a multiple component system in a preset, fixed ratio. In one embodiment, an atomized stream is generated for each component of a multiple component system. The atomized streams may be overlapped to intermix the fluids. The angle of intersection of the atomizer streams preferably is about 14°–19°.

The first and second cross-sectional areas of each atomizing portion determine the ratio of each component of a multiple component fluid system in the resulting atomizing streams. In one embodiment, the ratio of the fluids in their respective atomizing streams is between 13:1 to 17:1. In another embodiment, the ratio is between 20:1 to 30:1.

The container may be a flexible, polymeric bag. In one embodiment, the polymeric bag has a seal proximate a perimeter edge. A closable fitting extends into the bag for receiving a flexible tube. A releasable closure is provided proximate a portion of the perimeter edge. The releasable closure has a release pressure less than the burst strength of the flexible polymeric material. In one embodiment, the releasable closure is a rib and trough system. The flexible polymeric bag may include a gusset so as to be self-supporting when in an upright position. The flexible polymeric bags may be retained in a receptacle having a carrying handle. The flexible polymeric bag may also be made with an integral handle shaped into the bag perimeter.

The present invention is also directed to a container for receiving a fluid for use with a spraying apparatus. A flexible polymeric material is configured to form a pouch. A seal extending substantially around a perimeter edge of the flexible polymeric material retains a fluid within the pouch. A closable fitting extends into the pouch. The closable fitting has a closed position for retaining the fluids within the pouch and an opened position for receiving a flexible tubes in fluid communication with the fluid. A releasable closure is provided proximate a portion of the perimeter edge. The releasable closure has a release pressure less than the burst strength of the flexible polymeric material. The closable fitting may be retained between first and second layers of flexible polymeric material. In one embodiment, the releasable closure is a rib and trough closure system constructed to open in response to pressure within the container in excess of a predetermined amount.

The method of the present invention includes providing pressurized air to at least one nozzle assembly of the present invention. The pressurized air creates a reduced pressure condition in the passageway proximate the first fluid inlet port. The reduced pressure condition draws a fluid into the first fluid inlet ports. The fluid is expelled from the nozzle assembly and atomized. In the preferred embodiment, the multiple atomized streams are overlapped to intermix the components of a multiple component system.

Definitions used in this application:

"Fluid" shall mean any flowable, sprayable material, including, without limit, a paint, varnish, stain, mastic, gel-coat, cleaning solvent, sealant, lubricant, adhesive, pesticide, herbicide, cleaning or degreasing solvent, wear coating, abrasion resistant coating or slip coating.

"Multiple component fluid system" shall mean including, but not limited to, the combination of two or more fluids such as curing systems including a catalyst as one component and a reactive resin such as a two-part urethane, two-part adhesive systems, two-part epoxy systems; two-part latex systems; non-curing systems such as pigment/colorant and base compounds; and diluents and concentrates such as pesticides and herbicides and coatings in which particulate such as granular or encapsulated materials are incorporated into or onto a dispensed fluid.

BRIEF DESCRIPTION OF THE DRAWING

The present invention will be further described with reference to the accompanying drawing wherein like reference numerals refer to like parts in the several views.

While the above-identified drawing features set forth preferred embodiments, this disclosure presents illustrative embodiments of the present invention by way of representation and not by limitation. It should be understood that numerous other modifications and embodiments can be devised by those skilled in the art which fall within the spirit and scope of the principles of this invention. It should be noted that the figures have not been drawn to scale as it has been necessary to enlarge certain portions for clarity.

DETAILED DESCRIPTION OF THE PREFERRED EMBODIMENTS

Multiple fluid spraying systems are useful for simultaneously spraying two or more fluids, either onto a surface or into the air in the case of pesticides. Frequently, it is desirable to intermix the fluid spray with each other prior to encountering the surface. For example, some adhesive compounds, such as "Fastbond 2000-NF Adhesive" and "Fastbond Spray Activator," discussed above, include a first fluid resin and a second fluid activator, catalyst or modifier. Intermixing the first and second fluids in overlapping atomized sprays causes the adhesive to be tacky when applied to a surface.

Figure 1:
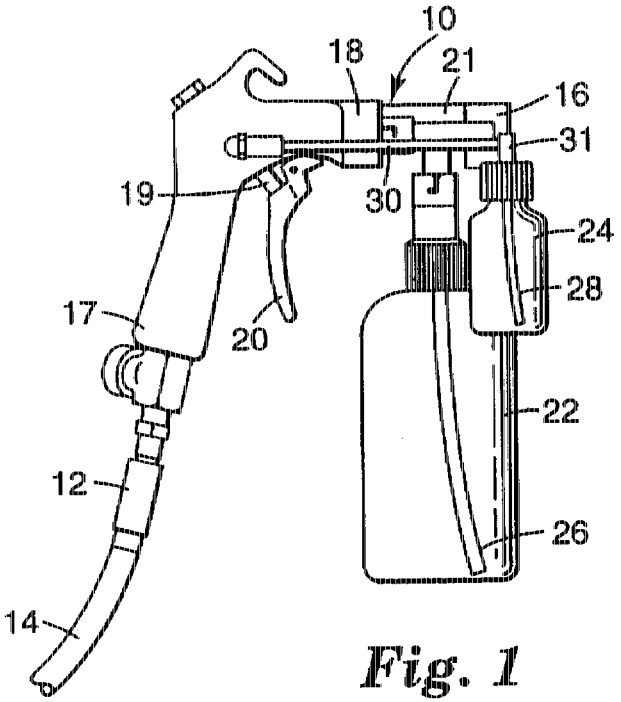
Fig. 1 PRIOR ART
FIG. 1 is a side view of a two-component fluid spraying system.
Figure 2:
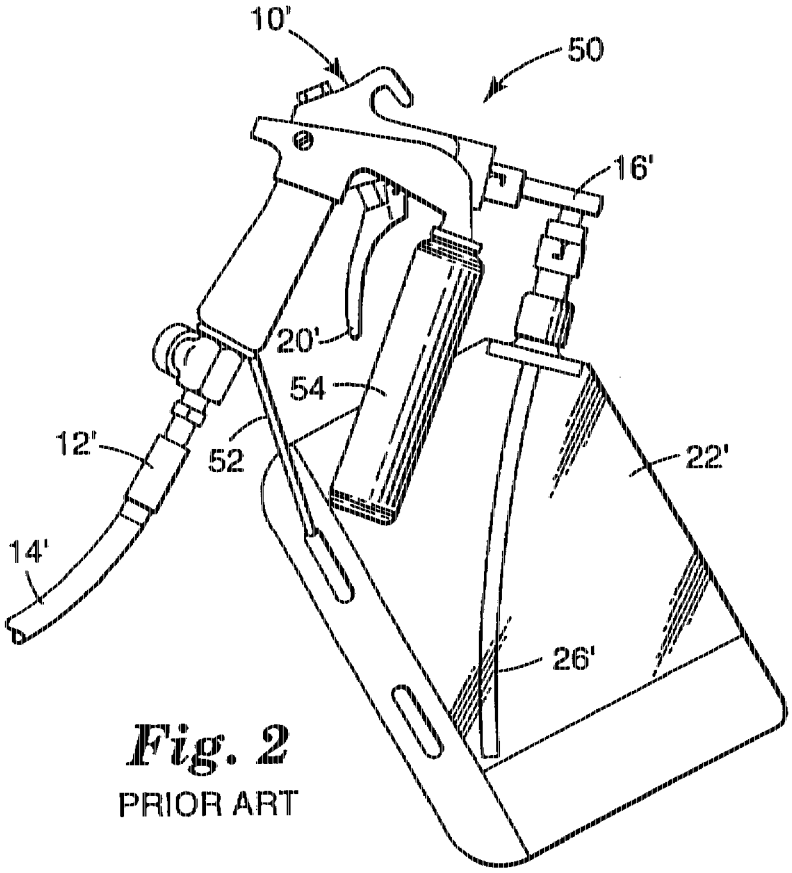
Fig. 2 PRIOR ART
FIG. 2 is a side view of an alternate two-component fluid spraying system with a flexible bag and an pressurized aerosol container attached to the spray applicator.
Figure 3:
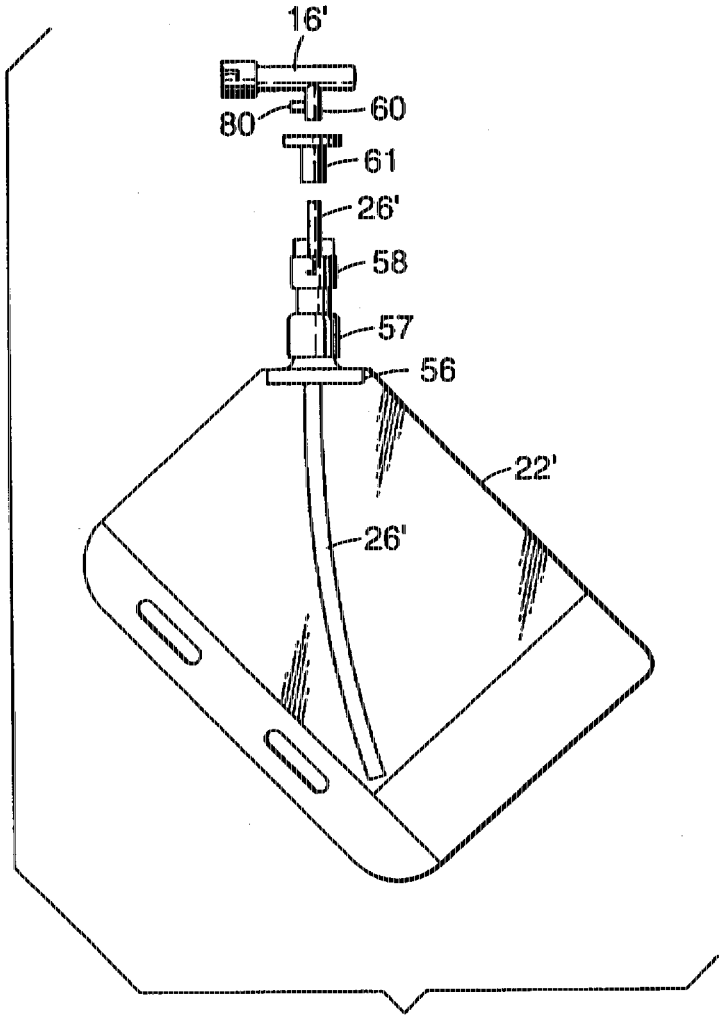
Fig. 3 PRIOR ART
FIG. 3 is a partial side exploded view of the attachment of the flexible bag of FIG. 2.
Figure 4:
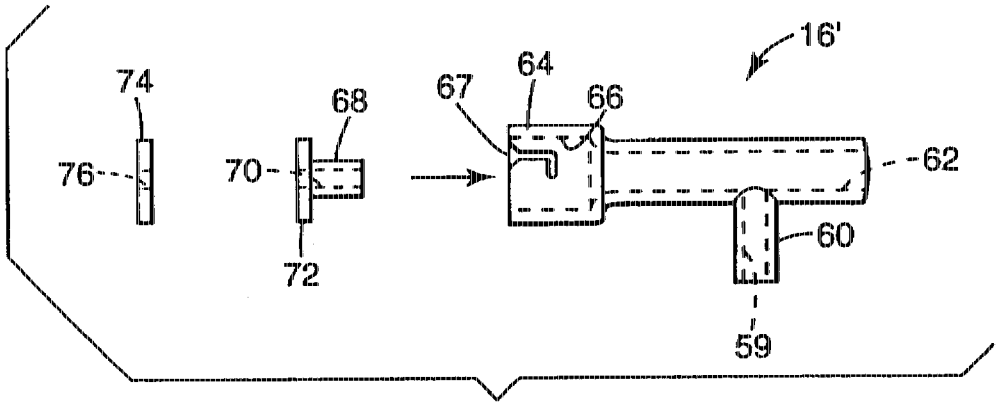
Fig. 4 PRIOR ART
FIG. 4 is a side exploded view of the spray nozzle of the conventional spray system of FIG. 2.
Figure 5:
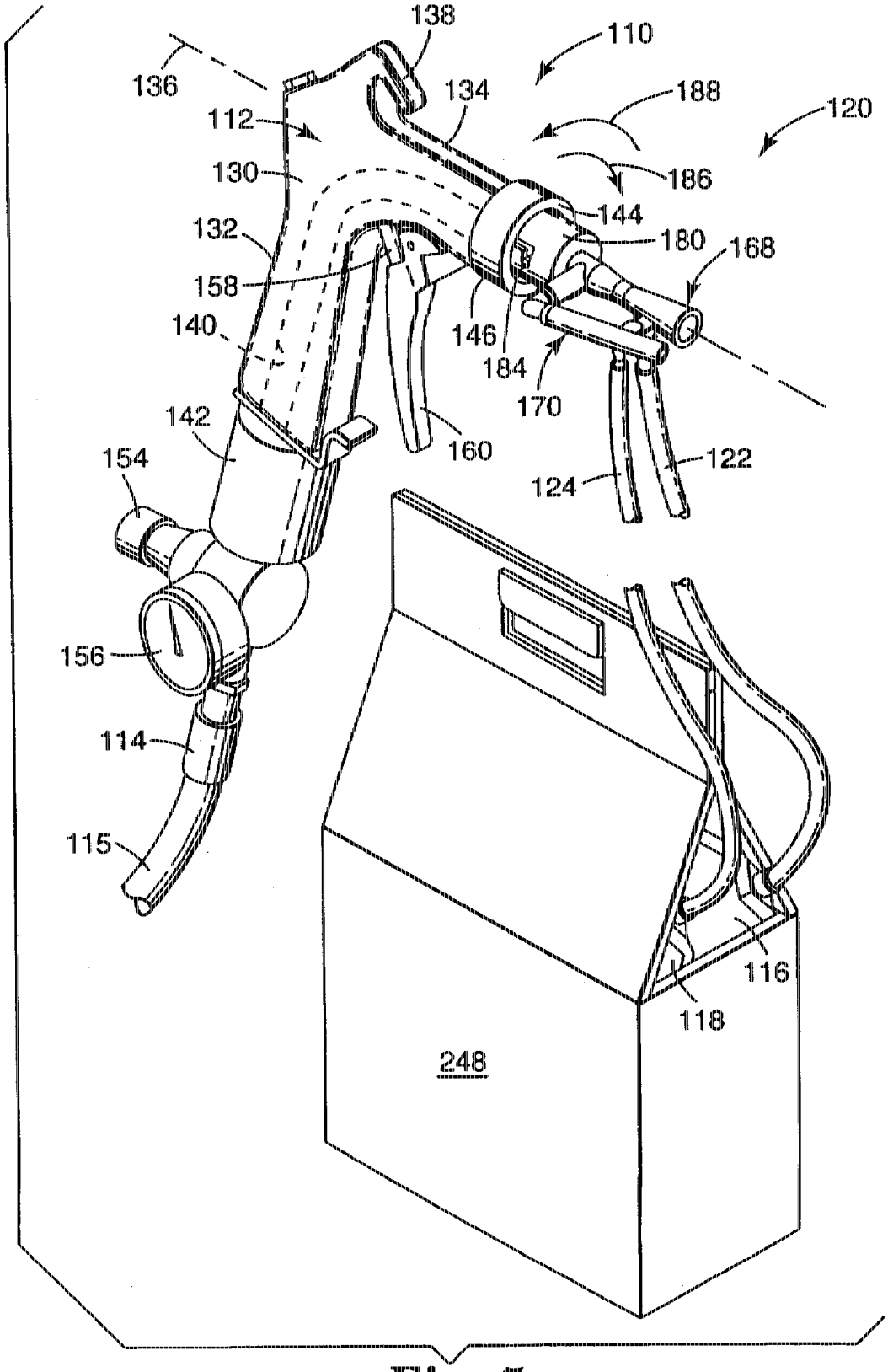
FIG. 5 is a perspective view of an exemplary multiple component spray system according to the present invention.
Figure 6:
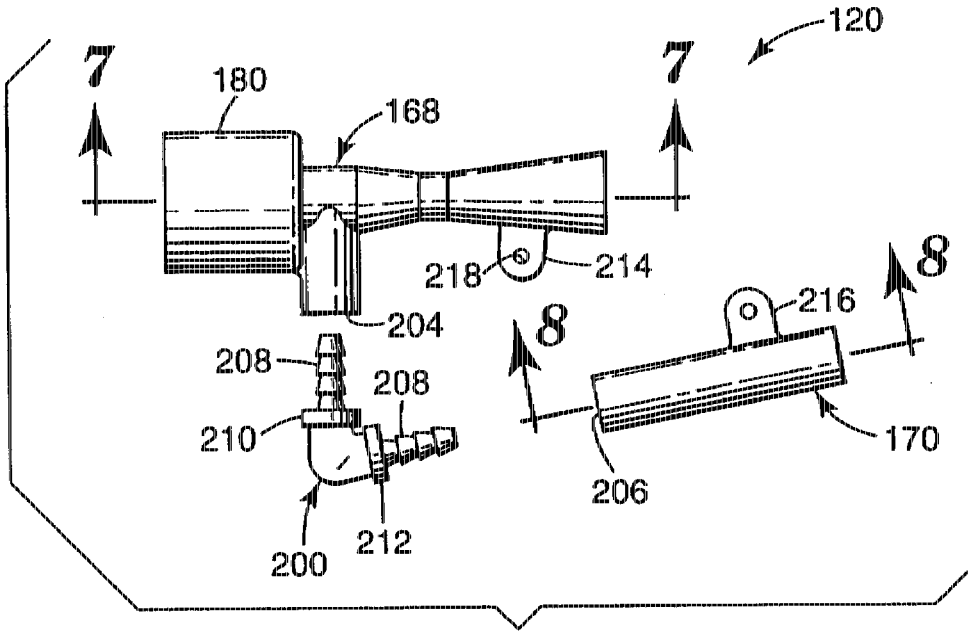
FIG. 6 is a top exploded view of an exemplary spray nozzle assembly for a multiple component spray system.

Referring now to FIG. 5, there is shown a multiple fluid spraying system 110 according to the present invention. System 110 includes spray applicator 112 connected by attachment 114 and hose 115 to a source of a pressurized fluid, most preferably air. The system 110 includes a first fluid container 116 and a second fluid container 118 retained in receptacle 248. The first and second fluid containers 116, 118 are for receipt of first and second fluids 116F, 118F (see FIG. 12) to be sprayed by the spraying system 110 of the present invention. It will be understood that although two fluid containers are illustrated, the present invention may be employed to spray a single fluid or more than two fluids, as may be found advantageous for a particular application or fluid. In such a case, a corresponding number of fluid containers, spray nozzles and ports on the spray applicator may be provided in conjunction with the fluid spraying system described herein.

Spray applicator further includes nozzle assembly 120 connected by first and second fluid conduits 122 and 124 to the first and second fluid containers 116 and 118, respectively. Suitable fluid conduits 122, 124 are available from Freelin-Wade Company, McMinnville, Oreg. The spray applicator 112, pressurized air from the hose 115, nozzle assembly 120, first and second fluid containers 116 and 118, and first and second fluid conduits 122 and 124 act to generate atomizer sprays of the first and second fluids 116F, 118F. The nozzle assembly 120 directs the atomized sprays into intersecting paths prior to encountering a surface.

The structure and operation of spray applicator 112 will now be described in greater detail. Spray applicator 112 includes housing 130, most conveniently provided in a "pistol" configuration with a handle portion 132 adapted for manual engagement and manipulation to direct the atomized sprays of the first and second fluids towards a desired surface. It will be understood, however, that the housing 130 may take any other suitable configuration as is found advantageous in a particular application. Barrel portion 134 projects generally orthogonally from the handle portion 132 along longitudinal axis 136. Hook 138 may optionally be provided to support the spray applicator 112 from a suitable support structure (not shown).

The housing 130 may be constructed from any suitable material, but is preferably constructed from a monolithic molded body of a polymeric or metallic material compatible with the fluids to be sprayed. Alternatively, the housing may be constructed of a pair of molded bifurcated mirror image portions (not shown) that are secured in sealing relationship. The following is a non-exclusive list of materials that may be used to construct the housing 130 of the spray applicator: aluminum, steel, polycarbonate, composites, epoxy, or some combination thereof.

Passageway 140 extends from a first end 142 though the handle portion 132 and the barrel portion 134 to second end 144 in manner that is directed away from the user of the spray applicator 112. Attachment 114 is sealingly mounted about first end 142 of the passageway 140 and is connected by pressurized air hose 115 to a source of pressurized air (not shown). Pressurized air thus flows though hose 115 and passageway 140 to second end 144.

As will be further discussed in the examples, the air pressure supplied to the spray applicator 112 is generally between 15 and 40 p.s.i. at a flow rate of approximately 2–5 c.f.m. Attachment 114 may include an adjustable valve 154 for regulating the flow rate for the air, or alternatively, the pressure. Gauge 156 may also be provided to display the flow rate or pressure of the air flowing into the spray applicator 112. A suitable valve/gauge assembly is available from Schrader Bellows located in Des Plaines, Ill.

The flow of the pressurized air through the spray applicator 112 is controlled by a valve 158 actuated by trigger 160. The valve 158 permits either a progressive increase in the flow rate of the air or a simple on-off arrangement at a pre-set flow rate. In the illustrated embodiment, the trigger 160 is biased to a closed position.

A first fluid atomizing portion 168 is mounted in sealing relation to the spray applicator 112 in fluid communication with the second end 144 of the passageway 140. A second atomizing portion 170 is fluidly connected to the first atomizing portion 168. Any suitable arrangement may be employed to sealingly mount the first fluid atomizing portion 168 on the spray applicator 112. As is illustrated in FIG. 5, skirt 180 extends concentrically away from the first fluid atomizing portion 168. The skirt 180 is adapted to slidingly receive the end of the barrel portion 134 of the spray applicator 112. Skirt 180 includes a "J" slot 182 (see FIG. 7) for engagement with a suitably sized post 184 radially projecting from the barrel portion 134. Relative rotation of the first fluid atomizing portion 168 with respect to the barrel portion in direction 186 around the axis 136 locks the first fluid atomizing portion 168 in place on the barrel portion 134 in fluid communication with the passageway 140 of the spray applicator 112. Relative rotation of the first fluid atomizing portion 168 with respect to the barrel portion 134 in opposing rotational direction 188 disengages the "J" slot 182 and the post 184, enabling the first fluid atomizing portion 168 to be removed from the spray applicator 112. The following is a non-exclusive list of commercially available spray applicators 112 that may be used in conjunction with the nozzle assembly 120 of the present invention: MAFA-Sebald Vertiesbsges of Breckerfeld, Germany and Off. Meccaniche A.N.I.S.p.A. of Via Arzignano, 132 Italy.

Referring now also to FIGS. 6–8 and 10, nozzle assembly 120 is provided to convey the flow of the pressurized air from the spray applicator 112 to draw the first and second fluids 116F, 118F from the first and second fluid containers 116, 118, respectively, in manner to be described in greater detail hereinafter. The first atomizing portion 168 is used in conjunction with the first fluid 116F and the second atomizing portion 170 is used in conjunction with the second fluid 118F.

The first and second atomizing portions 168, 170 are generally a venturi device operating under Bernoulli's theorem. Most simply stated, Bernoulli's theorem states that when a gas or fluid is flowed through a restricted area, as in a nozzle or venturi, its speed will increase and its temperature and pressure will decrease. If the cross-sectional area is increased as in a diffuser, the reverse is true. The total energy in a flowing gas is made up of static and dynamic temperatures, and static and dynamic pressures. A nozzle or diffuser does not change to total energy level, but rather changes one form of energy to another. For example, a nozzle will increase the flow, or dynamic pressure, at the expense of the static pressure. If the gas is moving through a passageway at so many pounds per second, the air must continue to flow at the same rate through the nozzle. The only way it can do this is to speed up. A diffuser will do the opposite. Thus by varying the cross-sectional area of a passageway, velocity can be changed into pressure, and pressure into velocity.

Figure 7:
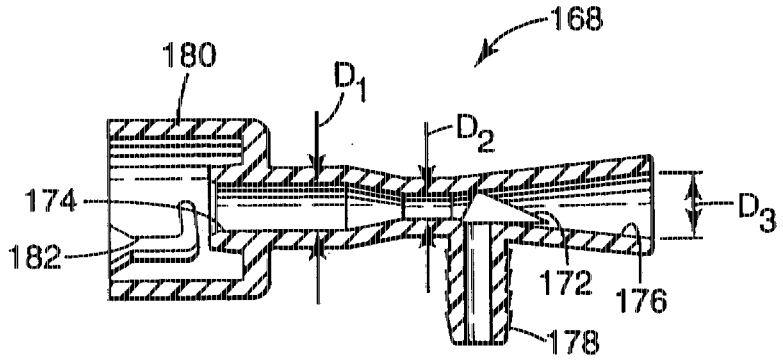
FIG. 7 is a side cross-sectional view perpendicular to plane 7—7 of a first spray portion of the nozzle of FIG. 6.

As best illustrated in FIG. 7, the first fluid atomizing portion 168 includes a passageway 172 extending from a first end 174 to a second end 176. A fluid induction port 178 is formed intermediate the first end 174 and the second end 176 of the passageway 172 to provide a "venturi" effect. The passageway 172 includes a first diameter D1 proximate the first end 174, a smaller diameter at D2 at an intermediate point, and an expanded diameter D3 that is larger than diameter D2 proximate the second end 176. This arrangement produces an increase in speed and a reduction in the pressure at D2 as the compressed air flows through the passageway 172 that draws the first fluid 116F into the first atomizing portion 168. The frusto-conical structure having a maximum diameter D3 at the second end 176 directs the resulting atomized stream along the axis 177 (see FIG. 10).

Figure 8:
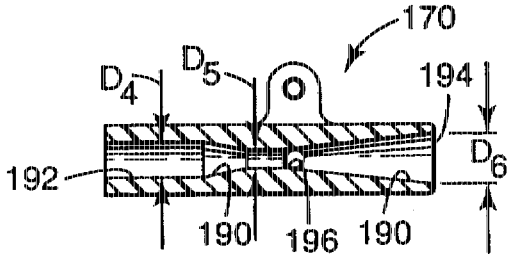
FIG. 8 is a top cross-sectional view perpendicular to plane 8—8 of a second spray portion of the nozzle of FIG. 6.

As illustrated in FIG. 8, the second fluid atomizing portion 170 includes a passageway 190 extending from a first end 192 to a second end 194. A fluid induction port 196 is formed intermediate the first end 192 and the second end 194 of the passageway 190 to provide a "venturi" effect. The passageway 190 includes a first diameter D4 proximate the first end 192, a smaller diameter D5 at an intermediate point and an expanded diameter D6 proximate the second end 194 that is larger than diameter D5. This arrangement produces an increase in speed and a reduction in the pressure at D5 that draws the second fluid 118F into the second atomizing portion 170. The frusto-conical structure having a maximum diameter D6 at the second end 194 directs the resulting atomized stream along the axis 199 (see FIG. 10).

It will be understood that the diameters D1–D6 are circular only for ease of manufacture and that the critical variable is the cross-sectional area of the passageways 172, 190 at the locations D1–D6. In particular, the cross-sectional shape of the passageways 172, 190 may be a variety of symmetrical or asymmetrical shapes.

The flow rate and level of atomization of the atomized stream from the first atomizing portion 168 is generally a function of the pressure of the supplied air, D1–D3, the diameter of the induction port 178 and the viscosity of the first fluid 116F. Likewise, the flow rate and level of atomization of the atomized stream from the second atomizing portion 170 is generally a function of the pressure of the supplied air, D4–D6, the diameter of the induction port 196 and the viscosity of the second fluid 118F. These variables determine the ratio of the first and second fluids emitted from the nozzle assembly 120.

For some multiple component fluid systems, the ratio of the individual components is critical to performance. The nozzle assembly 120 is designed to spray a fixed ratio of the first fluid 116F to the second fluid 118F at a given pressure of supplied air and viscosity, without any risk of operator error due to improper adjustment of the air pressure, flow rates, spray angles of the nozzles, etc. The present fixed-ratio nozzle assembly 120 provides a more accurate and reliable spraying of the fluids than can generally be achieved by other conventional spraying systems. It will be understood that low-cost nozzle assemblies 120 having different D1–D6 values may be easily manufactured to provide optimum spraying conditions for various multiple component fluid systems with the same beneficial result.

Additionally, the size, length, angle between the fluid sprays of the nozzle assembly 120 may be pre-set, eliminating the need for adjustment. Further, for most applications, it will be economically viable to simply dispose of the nozzle assembly 120 after each use, thus eliminating the need for cleaning prior to the next use. Finally, changeover for spraying of a different set of fluids is also easily and quickly accomplished by substituting a different nozzle assembly 120 fluidly connected to a different set of fluids.

Figure 9A:
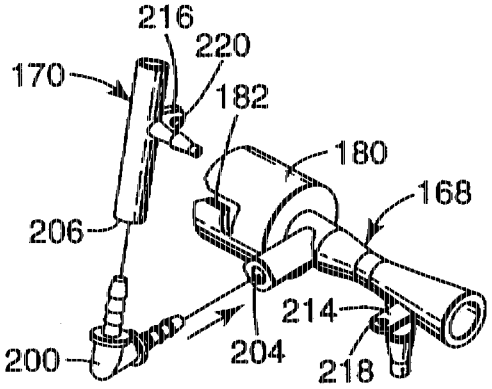
FIGS. 9A, 9B and 9C are sequential isometric views illustrating the assembly of the spray nozzle assembly of FIG. 6.
Figure 9B:
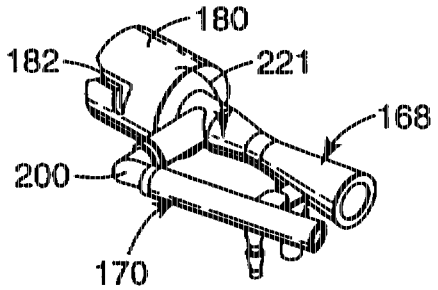
Figure 9C:
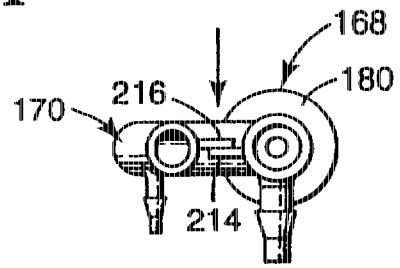

FIGS. 9A, 9B and 9C sequentially illustrate a method of assembling the first and second atomizing portions 168, 170 and connecting member 200 to each other. The connecting member 200 is inserted at each end into ports 204, 206, but with the second fluid atomizing portion 170 rotated approximately 90° from the final position. The second fluid atomizing portion 170 may then be rotated in direction 221 about the port 204 of the first fluid atomizing portion 168. Post 220 is thus positioned for engagement with aperture 218 to secure flanges 214, 216 to each other, as shown in FIG. 9C. The post 220 may be frictionally received within the aperture 218 so as to secure the flanges 214, 216, and thus the first and second fluid atomizing portions 168, 170 in a fixed relationship. As will be discussed below, the fixed relationship of the atomizing portions 168, 170 insures that the atomizer sprays are emitted in an overlapping pattern. It will be understood that other methods of assembling the first and second fluid atomizing portions 168, 170 of the nozzle assembly 120 may be selected. Further, other configurations may be utilized to construct the nozzle assembly 120, such as by molding a unitary molded polymeric body forming both venturi passageways 172 and 190.

Figure 10:
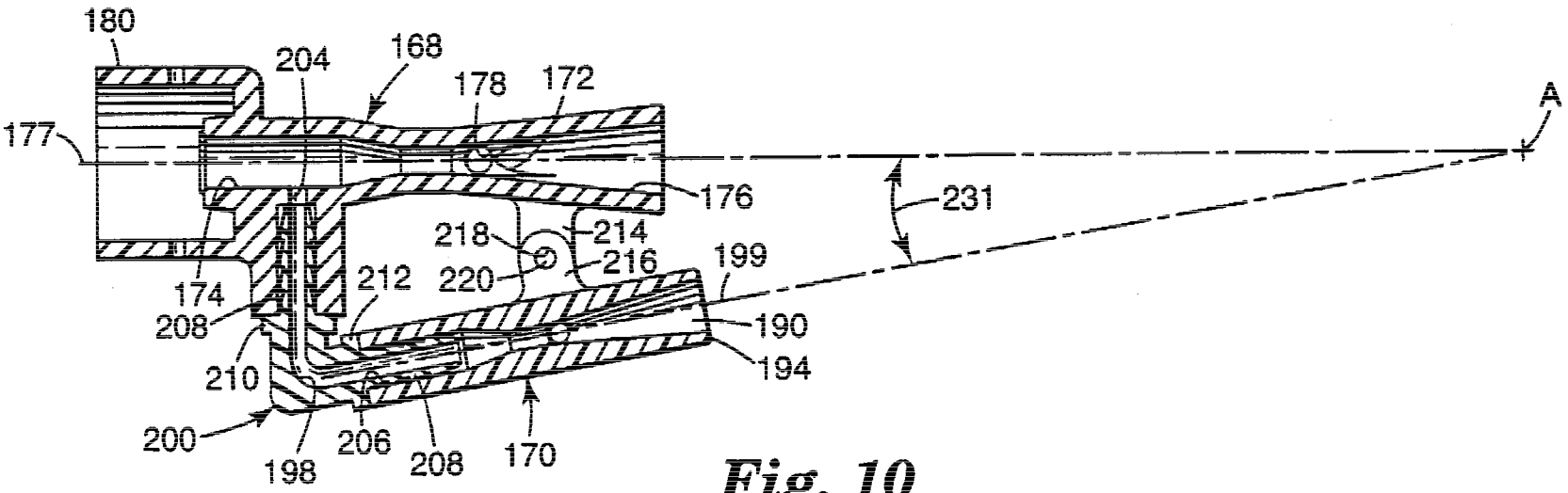
FIG. 10 is a top cross-sectional view of the spray nozzle assembly of FIG. 6.

It will be understood that the second fluid atomizing portion 170 may be connected to an independent source of pressurized air. However, in the preferred embodiment of the present invention as illustrated in FIG. 10, a portion of the stream of pressurized air adjacent the first end 174 of the first atomizing portion 168 is diverted through a passageway 198 to passageway 190. In the illustrated embodiment, the passageway 198 extends through the connecting member 200. The connecting member 200 is inserted into and secured at each end to ports 204, 206, respectively, as discussed above. Concentric tapered projections 208 enabling the connecting member 200 to be sealingly secured at each end to the first and the second fluid atomizing member 168, 170. Annular flanges 210, 212 define a secured position for the connecting member 200 relative to the first and second fluid atomizing members 168, 170. Passageway 198 extends through the connecting member 200 to provide fluid communication between passageways 172 and 190.

The low-cost, disposable nozzle assembly 120 is preferably constructed by premolding a unitary molded body from a polymeric material. The following is a nonexclusive list of the polymeric materials that may be utilized to construct the nozzle assembly 120: polystyrene, polypropylene, polyethylene, polyvinylchloride, polyacetal, and nylon. Additionally, the surface finish of the interior of the nozzle assembly 120 illustrated in FIG. 10 has a surface finish generally in the range of A1 to A2 according to the Society of the Plastics Industry Standard for Cosmetic Specifications of Injection Molded Parts, 1994. For purposes of this invention, the term "smooth" means to be formed in a manner that is free from irregularities, roughness, indentations, projections, protuberances or any abrupt changes in geometry that provides a location for the accumulation of solidified material.

As is best illustrated in FIG. 10, the second end 194 of the second atomizing portion 170 extends beyond and forward from the second end 176 of the first atomizing portion. For multiple component fluid systems utilizing an activator, the configuration in FIG. 10 minimizes coagulation, activation or catalyzation of the adhesive, epoxy, etc. on the nozzle assembly 120.

Figure 11:
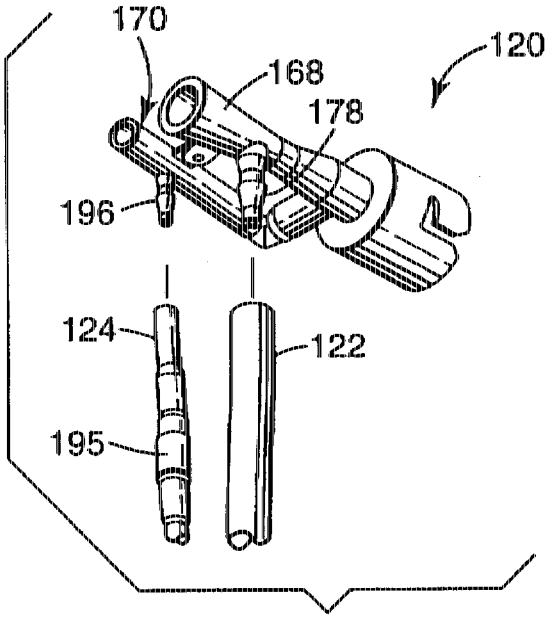
FIG. 11 is an isometric view of the nozzle of FIG. 6, partially exploded to show the connection of the fluid conduits.

FIG. 11 illustrates the connection of the conduit 122 to the induction port 178 on the first atomizing portion 168 and the second conduit 124 to the induction port 196 on the second atomizing portion 170. A check valve 195 may be interposed between the second conduit 124 and the second atomizing portion 170 to prevent the first fluid 116F from being drawn into the second fluid container 118 and to prevent fluid 118F from dropping back into the container 118. A check valve may also be included in the first conduit 122. A check valve suitable for use with the nozzle assembly 120 is available from Clippard Instrument Laboratory, Inc. located in Cincinnati, Ohio. Additionally, other fixed ratios can be achieved by inserting a flow restrictor in conduits 122, 124.

Figure 12:
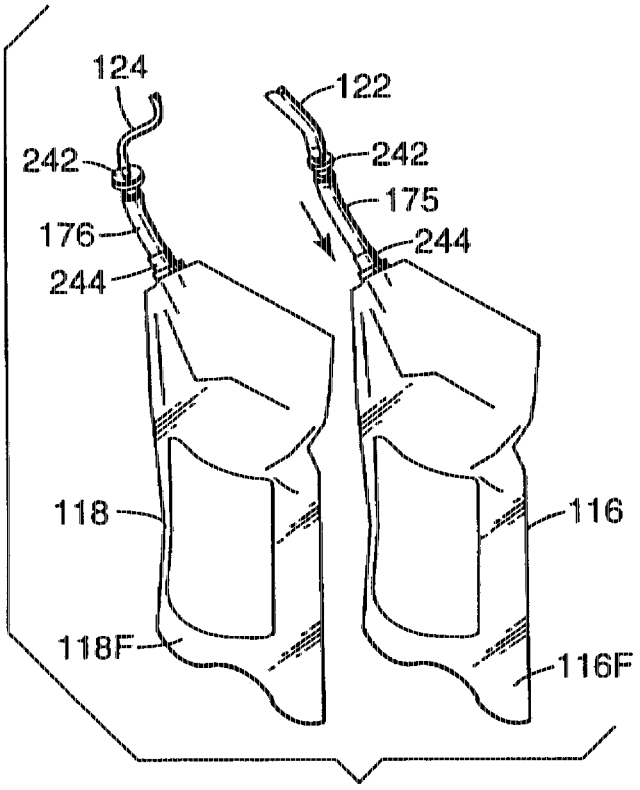
FIGS. 12 and 12A illustrate a connection of first and second fluid conduits to first and second fluid containers.
Figure 12A:
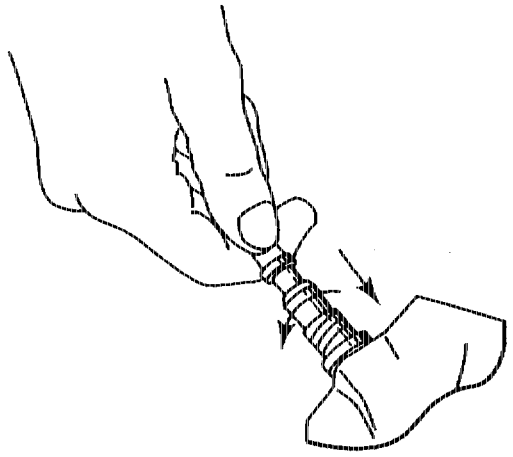

FIGS. 12 and 12A illustrate a system for independently moving and flexibly connecting each of the fluids to be sprayed from the spray applicator 112. It will be understood that any suitable container may be employed, such as bottles or the like (not shown). However, the flexible fluid containers 116, 118 offer certain advantages. The containers 116, 118 may be constructed from opposing generally rectangular polymeric sheets of laminated or non-laminated films bonded together along aligned edges as at seams in a manner known in the art. In the preferred embodiment of the invention, the fluid containers 116, 118 are flexible polymeric bags constructed of polyethylene terephthalate (PET), biaxially oriented nylon, linear low density polyethylene laminate available from Kapak Corporation of Minneapolis, Minn.

The first and second fluid container 116 and 118 are operatively connected to the nozzle assembly 120 by separate first and second fluid conduits 122, 124, respectively, so as to facilitate the carrying and manipulation of the spray applicator 112. The first and second fluid conduits 122, 124 are sealingly connected to the containers 116, 118 by frictional engagement with tapered annular projections 242. The tapered annular projections 242 are frictionally connected to draw tubes 175, 176, which extend through closable fitting 244 into the containers 116, 118. Alternatively, a tubing with an outside diameter equal to or less than the inside diameter of the opening in the closable fitting 244 may be used in place of the tapered annular projections 242. A flexible polymeric tubing, such as clear polyvinyl chloride (PVC) available from Freelin-Wade Company of McMinnville, Oreg., is suitable for use as the fluid conduits 122, 124 and draw tubes 175, 176.

Increased pressures within the containers 116, 118 may be generated by increased temperatures or chemical reaction of the substances, or clogging of either or both of the nozzles 168, 170. In an alternate container 230 illustrated in FIG. 14, a vent 245 responsive to the presence of pressure within the container 230 above a selected limit is provided. The vent 245 includes a segment of the container sealed by a releasable closure 246 located within the perimeter of seam 234. The releasable closure 246 may be constructed of a rib and trough closure system such as found on bags marketed under the trademark "Ziploc" pleated bags by Dow Brands, Inc. of Indianapolis, Ind. The container 230 has a tamper-evident, reclosable, reusable, pourable spout.

The seam 234 preferably extends around the entire perimeter of the container 230 to retain the fluid within the container 230 during shipping and handling. Prior to use, the operator preferably cuts a notch 247 part-way through the seam 234 in the container material proximate the closure 246. The releasable closure 246 provides a fluid impervious seal during normal use of the containers 230. However, if elevated pressures are encountered, the releasable closure 246 will be forced open at a particular level causing an audible report notifying the operator to release the excess pressure. The releasable closure enables a portion of the pressurized material within the container 230 to be released through the releasable closure 246 and notch 247 in the bag material, preventing a discharge of the material, with obvious undesirable consequences. The releasable closure 246 may also be opened during use of the spraying system 110 so that additional fluid or other material can be added to the container, without the need to suspend use of the spraying system 110. Alternatively, the seam 234 may be incomplete proximate the releasable closure 246 and a mechanical fastener substituted for closure 246 to retain the fluid during shipping and handling.

Figure 14:
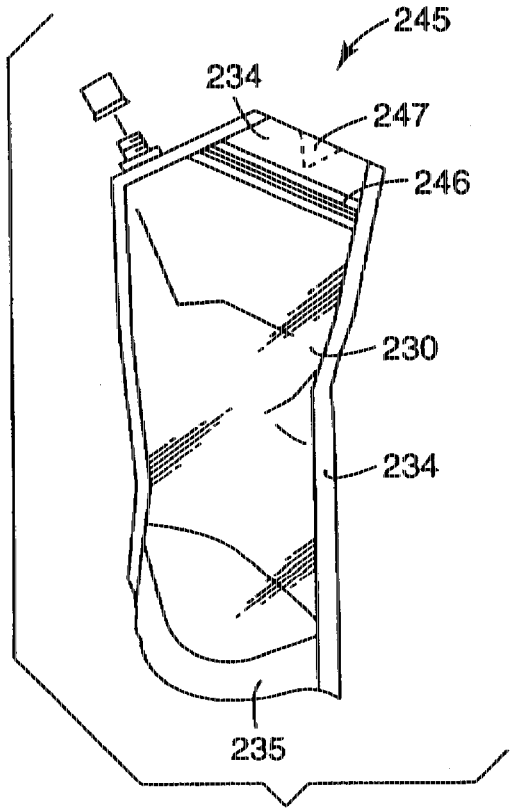
FIG. 14 is an isometric view of an alternate flexible fluid container having a venting member.

In the preferred embodiment of the invention, the flexible fluid containers 116, 118 are self supporting when in an upright or standing orientation, such as by forming gussets 235 in the bottom thereof (see FIG. 14). However, as it is desired to move the fluid spraying system 110 to varying locations, it may become inconvenient to carry both of the fluid containers 116, 118 as well as the spray applicator 112. Therefore, in the preferred embodiment of the invention, a receptacle 248 is provided having a cavity 250 (shown in FIGS. 5, 13 and 13A). Receptacle 248 is preferably rigid or at least sufficiently self supporting to receive and support the first and second fluid containers 116, 118 in an upright position within cavity 250 during use. The receptacle 248 may be conveniently constructed in a rectangular configuration. The receptacle is preferably constructed of a light weight material such as #160 high density polyethylene corrugated plastic available from Liberty Carton Company of Golden Valley, Minn. Polyethylene is preferred because of its durability and its resistance to water and solvent based products.

Figure 13:
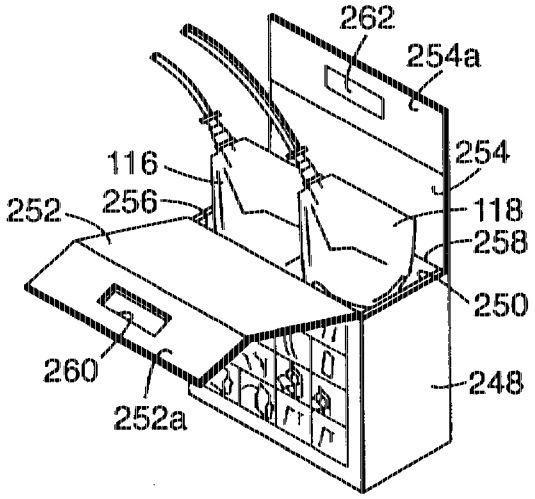
FIGS. 13 and 13A are isometric views of a receptacle for receiving and securing first and second fluid containers.
Figure 13A:
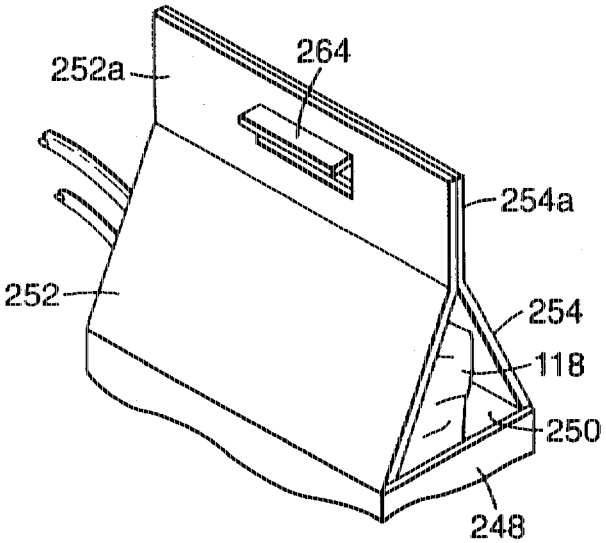

To further facilitate the manipulation of the first and second fluid containers, the receptacle 248 may include handle or like device adapted for manual engagement. One such handle is illustrated in FIGS. 13 and 13A in the form of opposed flaps 252, 254, each hingedly connected to opposed upper edges 256, 258 of the receptacle 248. Subflaps 252*a*, 254*a*, respectively may be brought together in a "gabletop" arrangement as shown in FIG. 13A. Each of the subflaps include aligned handle apertures 260 and 262 that may be manually engaged to carry and manipulate the receptacle. Most preferably, one of the subflaps includes securing flap 264 that may be pushed through the opposing handle aperture and frictionally retained therein. In this manner, the flaps and subflaps are maintained in the position shown in FIG. 13A during use. If it is desired to remove or replace either or both of the fluid containers 116, 118, the securing flap 264 may be disengaged from the opposing flap 252, 254 and the flaps separated. It will be understood that any other suitable arrangement may be employed to provide an handle for the receptacle, or to releasably secure the flaps and subflaps of FIGS. 13 and 13A in the position shown in FIG. 13A, such as hook and loop fasteners, clips, staples, tape, or adhesives. Instructions may be printed on the receptacle 248 for the convenience of the operator.

Figure 15:
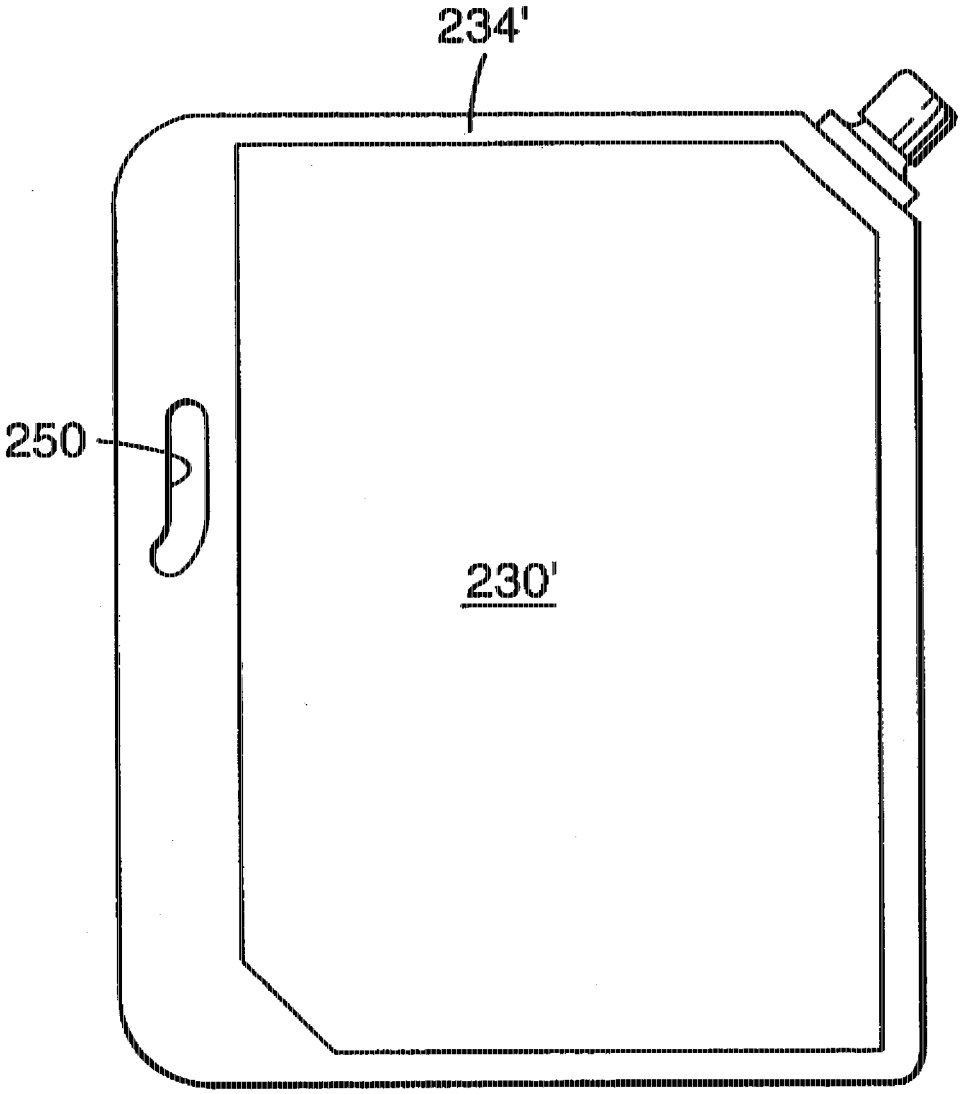
FIG. 15 is a plan view of an alternate flexible fluid container having an integral handle.

FIG. 15 illustrates an alternate bag 230' in which a handle 250 is integrally formed in or near seam 234'. One or more of the bags 230' may be carried by an operator along with the spray applicator 110.

As best illustrated in FIG. 5, valve 158 is opened, enabling the pressurized air to flow through the spray applicator 112 and the nozzle assembly 120, including both venturi passageways 172, 190. As best illustrated in FIG. 10, the reduced pressure adjacent to port 178 induces the first fluid 116F to be conveyed through first fluid conduit 122, port 178 and into the passageway 172. The first fluid 116F is thoroughly atomized by the encounter with the stream of pressurized air flowing through the passageway and is ejected along axis 177 from the second end 176 of the passageway 172 from the nozzle assembly 120. Preferably, the axis 177 is aligned with axis 136 of passageway 140 in barrel portion 134 of the spray applicator housing 130 (see FIG. 5). Similarly, the reduced pressure adjacent to the port 196 induces the second fluid to be conveyed through second fluid conduit 124 and port 196 into passageway 190. The second fluid 118F is thoroughly atomized by the encounter with the stream of pressurized air flowing through the passageway 190 and is ejected along axis 199 from the second end of the passageway 190 of the nozzle assembly 120.

The axes 177 and 199 of the sprays emerging from the first and second fluid atomizing portions 168, 170 intersect and intermix at a desired location spaced from the nozzle assembly 120 (as at "A"). This configuration enables the first and second fluids 116F, 118F to intermix and interact prior to encountering the surface to which they are to be applied. The angle 231 between the axes 177 and 199 may be determined, in part, by the configuration of the connecting member 200, as shown in FIG. 10. The intersection angle of the two spray streams is preferably between 14° and 19°

EXAMPLES

Delivery Rate

The spray system to be tested was secured with a clamp in a vertical position so that the spray nozzle assembly was about 30 cm (12 inches) from the mid-point of the surface of a drum 41 cm (16 inches) high by 38 cm (15 inches) diameter rotating at 18 RPM, on which a transparent film was attached. A two-part, water-based adhesive system was used as the material to be sprayed. The adhesive was a contact adhesive having nominal 49% solids content and Brookfield viscosity of 200--700 cps and the activator was a water thin, inorganic salt solution having nominal 15% solids content (3M 'Fastbond' 2000-NF Adhesive and 3M 'Fastbond' Spray Activator, commercially available from Minnesota Mining and Manufacturing Company, St. Paul, Minn.). With fluid container feed lines attached to the spray applicator, air lines connected to the spray nozzle, and the air supply turned on, the fluid containers were each placed on a separate electronic balance to determine their initial weight. The spray applicator was actuated for about 30 seconds, depositing material on the transparent film. The fluid containers were then each weighed again (final weight). The difference between the initial weight and the final weight multiplied by 2 gave the "Delivery Rate" in grams/minute for the adhesive and for the activator.

Degree of Activation

The material coated transparent film from the Delivery Rate test was removed from the drum and immediately tested for degree of activation by lightly touching the back area between the first and second knuckle of either the index or middle finger against the adhesive surface. For the adhesive system tested, the material was rated as very (v) wet to wet (low adhesive activation), dry to very (v) dry (high adhesive activation), or tacky to slightly (sl) tacky (desired adhesive activation).

Spray Width

Using the material coated transparent film from the Degree of Activation test, at least 2 measurements of the major dimensions were taken and the average was determined to be the "Spray Width". A desired result is an average spray width of 5.0--10.16 cm (2--4 inches).

Uniformity of Particle Spray

The material coated transparent film from the Spray Width test was visually inspected for uniformity of particles. If at least 80 percent of the spray was of similar size, the spray was observed to be uniform.

Examples 1--3

In examples 1--3, the effect of varying the air pressure for the activator and for the adhesive was determined.

A spray system of the invention was fitted with a spray nozzle assembly having the following dimensions as referenced on FIG. 7: D1 was 5.94 mm (0.234 inches), D2 was 3.175 mm (0.125 inches), D3 was 8.89 mm (0.35 inches) and the diameter of port 178 was 2.29 mm (0.090 inches); as referenced on FIG. 8, D4 was 4.47 mm (0.176 inches), D5 was 1.27 mm (0.050 inches), D6 was 5.82 mm (0.229 inches); and the diameter of port 196 was 0.508 mm (0.020 inches). The spray nozzle assembly was made of acrylonitrile butadiene styrene copolymer (ABS). Flexible containers containing the material to be sprayed, air lines and supply lines were attached to the spray applicator and the spray system was tested according to the test methods outlined above using varying air pressure for the adhesive and for the activator.

The air pressure for the adhesive and activator, delivery rates of the adhesive and activator, the degree of activation, spray width, and uniformity of particle spray are presented in Table 1 below.

TABLE 1

| Example | Air Pressure, MPa (psig) | | Delivery Rate g/min | | Spray Width | Uniformity of | Degree of |
|---|---|---|---|---|---|---|---|
| No. | Adhesive | Activator | Adhesive | Activator | cm (inches) | Particle Spray | Activation |
| 1 | 0.069 (10) | 0.069 (10) | 60 | 8 | 8 (3.1) | non-uniform | sl. dry |
| 2 | 0.103 (15) | 0.103 (15) | 60 | 20 | 8 (3.1) | uniform | v. dry |
| 3 | 0.165 (24) | 0.165 (24) | 60 | 12 | 8 (3.1) | uniform | v. dry |

From the data it can be seen that varying the air pressure affects the delivery rate of the activator and the uniformity of particle spray.

Examples 4--6

In examples 4--6, the effect of varying the air pressure for the activator and for the adhesive was determined.

A spray system of the invention was prepared and tested as in Examples 1--3 with the exception that the spray nozzle assembly had the following dimensions: D2 was 2.794 mm (0.110 inches) and the diameter of port 178 was 2.39 mm (0.094 inches); as referenced on FIG. 8, D5 was 1.52 mm (0.060 inches) and for Example 6, the diameter of port 196 was 0.381 mm (0.015 inches).

The air pressure for the adhesive and activator, delivery rates of the adhesive and activator, the degree of activation, spray width, and uniformity of particle spray are presented in Table 2 below.

TABLE 2

| Example | Air Pressure, MPa (psig) | | Delivery Rate g/min | | Spray Width | Uniformity of | Degree of |
|---|---|---|---|---|---|---|---|
| No. | Adhesive | Activator | Adhesive | Activator | cm (inches) | Particle Spray | Activation |
| 4 | 0.165 (24) | 0.165 (24) | 150 | 15 | 10 (4) | non-uniform | dry |
| 5 | 0.138 (20) | 0.138 (20) | 120 | 14 | 8 (3) | non-uniform | dry |
| 6 | 0.138 (20) | 0.138 (20) | 120 | 12 | 8 (3) | non-uniform | dry |

From the data it can be seen that increasing the air pressure of Example 5 by 20% (Ex. 4), increases the delivery rate of the adhesive and the spray width by 25% and the delivery rate of the activator by 7%. A 33% increase of the diameter of port 196 (Ex. 6 vs. Ex. 5) results in 17% increase in the activator delivery rate.

Examples 7–10

In examples 7–10, the effect of varying the air pressure for the activator and for the adhesive was determined.

A spray system of the invention was prepared and tested as in Examples 1–3 with the exception that the spray nozzle assembly had the following dimensions: D2 was 2.82 mm (0.111 inches) and the diameter of port 178 was 3.05 mm (0.120 inches); as referenced on FIG. 8, D5 was 2.36 mm (0.093 inches) and the diameter of port 196 was 1.016 mm (0.040 inches), and was made of high density polyethylene.

The air pressure for the adhesive and activator, delivery rates of the adhesive and activator, the degree of activation, spray width, and uniformity of particle spray are presented in Table 3 below.

TABLE 3

| Example | Air Pressure, MPa (psig) | | Delivery Rate g/min | | Spray Width | Uniformity of | Degree of |
|---|---|---|---|---|---|---|---|
| No. | Adhesive | Activator | Adhesive | Activator | cm (inches) | Particle Spray | Activation |
| 7 | 0.193 (28) | 0.193 (28) | 140 | 8 | 10 (4) | uniform | sl. tacky |
| 8 | 0.138 (20) | 0.138 (20) | 130 | 8 | 10 (4) | uniform | sl. tacky |
| 9 | 0.124 (18) | 0.124 (18) | 128 | 4 | 8–10 (3–4) | uniform | wet |
| 10 | 0.103 (15) | 0.103 (15) | 120 | 2 | 8 (3) | uniform | v. wet |

From the data it can be seen that with increasing air pressure, the delivery rate of the adhesive, and the spray width increase and the degree of activation changes from very wet to slightly tacky.

Examples 11–14

In examples 11–14, the effect of varying the air pressure for the activator and for the adhesive was determined.

A spray system of the invention was prepared and tested as in Examples 7–10 with the exception that the spray nozzle assembly had the following dimension: the diameter of port 196 was 0.508 mm (0.020 inches).

The air pressure for the adhesive and activator, delivery rates of the adhesive and activator, the degree of activation, spray width, and uniformity of particle spray are presented in Table 4 below.

TABLE 2

| Example | Air Pressure, MPa (psig) | | Delivery Rate g/min | | Spray Width | Uniformity of | Degree of |
|---|---|---|---|---|---|---|---|
| No. | Adhesive | Activator | Adhesive | Activator | cm (inches) | Particle Spray | Activation |
| 11 | 0.193 (28) | 0.193 (28) | 130 | 4 | 10 (4) | uniform | sl. tacky |
| 12 | 0.138 (20) | 0.138 (20) | 130 | 8 | 10 (4) | uniform | sl. tacky |
| 13 | 0.124 (18) | 0.124 (18) | 130 | 4 | 8–10 (3–4) | uniform | sl. wet |
| 14 | 0.103 (15) | 0.103 (15) | 110 | 2 | 8 (3) | uniform | v. wet |

From the data it can be seen that with the nozzle dimensions of Examples 11–14, the delivery rate of the activator was maximized at 0.138 MPa.

It will be understood that the exemplary embodiments in no way limit the scope of the invention. Other modifications of the invention will be apparent to those skilled in the art in view of the foregoing descriptions. These descriptions are intended to provide specific examples of embodiments which clearly disclose the invention. Accordingly, the invention is not limited to the described embodiments or to the use of specific elements, dimensions, materials or configurations contained therein. All alternative modifications and variations of the present invention which fall within the spirit and broad scope of the appended claims are covered.

What is claimed is:

1. A fluid spraying system, comprising:

at least one container for receiving at least one fluid comprising;

a flexible polymeric material having a seal proximate a perimeter edge;

a closable fitting for receiving the at least one tube; and a releasable rib and trough closure system proximate a portion of the perimeter edge, the releasable closure having a release pressure less than the burst strength of the flexible polymeric material;

a spray applicator for controlling the flow of pressurized air to a nozzle assembly, the nozzle assembly comprising;

at least one atomizing portion defining a passageway in fluid communication at a first end with the pressurized air of the spray applicator, the passageway having a first cross-sectional area proximate the first end, a second cross-sectional area less than the first cross-sectional area proximate a middle portion, and a fluid inlet port between the middle portion and a second end so that a reduced pressure condition is created in the passageway proximate the fluid inlet port when pressurized air is supplied to the nozzle assembly, a portion of the passageway of the first atomizing portion between the middle portion and the second end having a generally frusto-conical shape with a base of the frusto-conical shape proximate the second end; and at least one tube fluidly connecting the at least one container with the fluid inlet port of the atomizing portion so that the a fluid contained within the at least one container is drawn through the fluid inlet port and expelled in an atomized stream from the second end of the atomizing portion when pressurized air is supplied to the nozzle assembly.

2. The apparatus of claim 1 wherein the at least one atomizing portion comprises two atomizing portions.

3. An apparatus for spraying a multiple component fluid system, comprising:

at least a first and a second container for receipt of a first and a second fluid, respectively, the first and second containers including a rib and trough closure system constructed to open in response to pressure within the first and second containers in excess of a predetermined amount;

a spray applicator for controlling the flow of pressurized air to a nozzle assembly, the nozzle assembly comprising;

a first atomizing portion defining a passageway in fluid communication at a first end with the pressurized air of the spray applicator, the passageway having a first cross-sectional area proximate the first end, a second cross-sectional area less than the first cross-sectional area proximate a middle portion, and a first fluid inlet port between the middle portion and a second end so that a reduced pressure condition is created in the passageway proximate the first fluid inlet port when pressurized air is supplied to the nozzle assembly;

a second adjacent atomizing portion defining a passageway in fluid communication at a first end with the pressurized air of the spray applicator, the passageway having a third cross-sectional area proximate the first end, a fourth cross-sectional area less than the third cross-sectional area proximate a middle portion, and a second fluid inlet port between the middle portion and a second end so that a reduced pressure condition is created in the passageway proximate the second fluid inlet port when pressurized air is supplied to the nozzle assembly; and at least a first tube fluidly connecting the first fluid in the first container with the first fluid inlet port of the first atomizing portion and a second tube fluidly connecting the second fluid in the second container with the second fluid inlet port of the second atomizing portion so that the first and second fluids are capable of being drawn through the first and second fluid inlet ports and expelled in first and second atomized streams from the second ends of the first and second atomizing portions, respectively, when pressurized air is supplied to the nozzle assembly, the first and second atomizing streams being capable of overlapping to intermix the first and second fluids.

4. The apparatus of claim 3 wherein the at least first and second containers comprise a plurality of flexible, polymeric bags.

5. The apparatus of claim 4 wherein the at least first and second containers include pressure release means for releasing pressure within the containers in excess of a predetermined amount.

6. The apparatus of claim 3 wherein the at least first and second containers comprise:

a flexible polymeric material having a seal proximate a perimeter edge;

a closable fitting for receiving the first and second flexible tubes; and a releasable closure proximate a portion of the perimeter edge, the releasable closure having a release pressure less than the burst strength of the flexible polymeric material.

7. The apparatus of claim 4 wherein the flexible polymeric bag includes a gusset proximate a bottom portion so that the flexible, polymeric bag is self-supporting when in an upright position.

8. The apparatus of claim 4 wherein the first and second flexible bags are retained in a receptacle having a carrying handle.

9. The apparatus of claim 4 wherein the first and second flexible bags further include an integral handle.

10. The apparatus of claim 3 wherein the first and second atomized streams overlap to intermix the first and second fluids.

11. The apparatus of claim 3 wherein the passageways of the first and second atomizing portions define intersecting axes having an angle of intersection of about 14°–19°.

12. The apparatus of claim 3 wherein a portion of the passageway of the first atomizing portion between the middle portion and the second end comprises a generally frusto-conical shape with a base of the frusto-conical shape proximate the second end.

13. The apparatus of claim 3 wherein a portion of the passageway of the second atomizing portion between the middle portion and the second end comprises a generally frusto-conical shape with a base of the frusto-conical shape proximate the second end.

14. The apparatus of claim 3 wherein the first and second fluids comprise a two-part water based adhesive.

15. The apparatus of claim 14 wherein the two-part water based adhesive comprises an adhesive base and an activator.

16. The apparatus of claim 3 wherein the first and second cross-sectional areas of the first atomizing portion and the third and fourth cross-sectional areas of the second atomizing portion determine the ratio of the first and second fluids in the first and second atomizing streams.

17. The apparatus of claim 3 wherein the ratio of the first and second fluids in the first and second atomizing streams comprises between 13:1 to 17:1.

18. The-apparatus of claim 3 wherein the ratio of the first and second fluids in the first and second atomizing streams comprises between 20:1 to 30:1.

19. The apparatus of claim 3 wherein the first fluid comprises an activator of the second fluid.

20. A spray applicator system comprising:

a first atomizing portion defining a passageway in fluid communication at a first end with a source of pressurized air, the passageway having a first cross-sectional area proximate the first end, a second cross-sectional area less than the first cross-sectional area proximate a middle portion, and a first fluid inlet port between the middle portion and a second end so that a reduced pressure condition is created in the passageway proximate the first fluid inlet port when pressurized air is supplied to the nozzle assembly, a portion of the passageway of the first atomizing portion between the middle portion and the second end having a generally frusto-conical shape with a base of the frusto-conical shape proximate the second end, whereby the reduced pressure condition is sufficient to draw a fluid through the first fluid inlet port and to expel an atomized stream from the second end of the first atomizing portion;

a second atomizing portion comprising a passageway having a third cross-sectional area proximate a first end, a fourth cross-sectional area less than the third cross-sectional area proximate a middle portion, and a second fluid inlet port between the middle portion and a second end so that a reduced pressure condition is created in the passageway proximate the second fluid inlet port when pressurized air is supplied to the second atomizing portion, a portion of the passageway of the second atomizing portion between the middle portion and the second end having a generally frusto-conical shape with a base of the frusto-conical shape proximate the second end, the first end of the second atomizing portion fluidly connected proximate to the first end of the first atomizing portion by an angled connector, the angled connector retaining the passageway of the first atomizing portion in a fixed relationship with respect to the passageway of the second atomizing portion whereby the first and second atomizing portions are capable of generating overlapping first and second atomizing streams; and first and second containers in fluid communication with the first and second fluid inlet ports, respectively, the first and second containers including a rib and trough closure system constructed to open in response to pressure within the first and second containers in excess of a predetermined amount.

21. The apparatus of claim 20 wherein the second end of the second atomizing portion extends beyond the second end of the first atomizing portion.

22. The apparatus of claim 20 wherein the first atomizing portion comprises a unitary polymeric structure.

23. A method of applying a multiple component fluid system, comprising the steps of:

providing pressurized air to a nozzle assembly, the nozzle assembly having a first atomizing portion defining a passageway in fluid communication at a first end with the pressurized air, the passageway having a first cross-sectional area proximate the first end, a second cross-sectional area less than the first cross-sectional area proximate a middle portion, and a first fluid inlet port between the middle portion and a second end;

creating a reduced pressure condition in the passageway proximate the first fluid inlet port when pressurized air is supplied to the nozzle assembly;

providing pressurized air to a second adjacent atomizing portion, the second atomizing portion defining a passageway in fluid communication at a first end with the pressurized air, the passageway having a third cross-sectional area proximate the first end, a fourth cross-sectional area less than the third cross-sectional area proximate a middle portion, and a second fluid inlet port between the middle portion and a second;

creating a reduced pressure condition in the passageway proximate the second fluid inlet port when pressurized air is supplied to the nozzle assembly;

drawing first and second fluids into the first and second fluid inlet ports from first and second containers containing first and second fluids, respectively, the first and second containers including a rib and trough closure system constructed to open in response to pressure within the first and second containers in excess of a predetermined amount; and expelling first and second atomized streams from the second ends of the first and second atomizing portions, respectively, when pressurized air is supplied to the nozzle assembly whereby the first and second atomized streams are capable of overlapping to intermix the first and second fluids.

24. The method of claim 23 further comprising the steps of drawing first and second fluids into the first and second fluid inlet ports comprises the steps of:

retaining first and second fluids in first and second flexible polymeric bags, respectively; and extending first and second flexible tube through a closable fitting on the first and second flexible polymeric bags to fluidly couple the first and second fluid inlet ports with the first and second fluids.

25. The method of claim 23 further including the step of locating a releasable closure proximate a portion of a perimeter edge of the first and second flexible polymeric bags, the releasable closure having a release pressure less than the burst strength of the flexible polymeric bags.

26. The method of claim 23 wherein the first and second atomizing portions are positioned to produce overlapping atomized streams.

27. The method of claim 23 wherein the passageways of the first and second atomizing portions define intersecting axes having an angle of intersection of about 14°–19°.

28. The method of claim 23 wherein the passageway of the first atomizing portion between the middle portion and the second end comprises a generally frusto-conical shape with a base of the frusto-conical shape proximate the second end.

29. The method of claim 23 wherein the first and second fluids comprise a two-part water based adhesive.

30. A method of applying a fluid, comprising the steps of:

providing pressurized air to a nozzle assembly, the nozzle assembly having a first atomizing portion defining a passageway in fluid communication at a first end with the pressurized air, the passageway having a first cross-sectional area proximate the first end, a second cross-sectional area less than the first cross-sectional area proximate a middle portion and a first fluid inlet port between the middle portion and a second end, a portion of the passageway of the first atomizing portion between the middle portion and the second end having a generally frusto-conical shape with a base of the frusto-conical shape proximate the second end;

creating a reduced pressure condition in the passageway proximate the first fluid inlet port when pressurized air is supplied to the nozzle assembly;

providing at least one container for receiving at least one fluid, the container comprising a flexible polymeric material having a seal proximate a perimeter edge, a closable fitting for receiving the at least one flexible tube, and a releasable rib and trough closure system proximate a portion of the perimeter edge, the releasable closure having a release pressure less than the burst strength of the flexible polymeric material;

drawing a fluid from the at least one container into the first fluid inlet port; and expelling first atomized streams from the second ends of the first atomizing portion when pressurized air is supplied to the nozzle assembly.

* * * * *